US006598437B2

(12) United States Patent
Choi

(10) Patent No.: US 6,598,437 B2
(45) Date of Patent: Jul. 29, 2003

(54) DOOR UNLOCKING SYSTEM FOR VEHICLES

(75) Inventor: Jae Hong Choi, Gwangmyeong-si (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 09/977,891

(22) Filed: Oct. 11, 2001

(65) Prior Publication Data

US 2002/0170325 A1 Nov. 21, 2002

(30) Foreign Application Priority Data

May 16, 2001 (KR) ..... 2001-26760

(51) Int. Cl.[7] ..... E05B 53/00; E05B 63/14; E05B 65/36

(52) U.S. Cl. ..... 70/264; 70/239; 70/255; 292/DIG. 25

(58) Field of Search ..... 70/264, 239, 254–257, 70/262, 263, 280–282; 292/DIG. 25

(56) References Cited

U.S. PATENT DOCUMENTS 5,050,410 A * 9/1991 Claar et al. ..... 70/237
5,184,022 A * 2/1993 Claar et al. ..... 307/10.2
5,224,364 A * 7/1993 Claar et al. ..... 70/237
5,238,274 A * 8/1993 Becker et al. ..... 292/201
5,309,743 A 5/1994 Kokubu et al. ..... 70/257
5,676,003 A * 10/1997 Ursel et al. ..... 70/472
5,699,685 A * 12/1997 Jahrsetz et al. ..... 70/264
5,722,272 A * 3/1998 Bridgeman et al. ..... 70/264
6,065,316 A * 5/2000 Sato et al. ..... 70/264
6,072,403 A 6/2000 Iwasaki et al. ..... 340/825.31

* cited by examiner

*Primary Examiner*—Anthony Knight
(74) *Attorney, Agent, or Firm*—Christie, Parker & Hale, LLP

(57) ABSTRACT

The invention provides a door unlocking system with the switch transmitting the signal to the central processing unit (10) according to the rotary direction of the key inserted into the key box to unlock the front and rear doors, wherein the switch is installed at the door latch (30) unlocking the driver door and the switch transmits the signal to the central processing unit according to the signal input in the key rod clip (31) to unlock the other doors, in the inserted status, the key turns to one direction to operate the switch, thereby installing the switch in the driver door regardless of the door chassis and the key rotor.

4 Claims, 2 Drawing Sheets

DOOR UNLOCKING SYSTEM FOR VEHICLES

CROSS-REFERENCE TO RELATED APPLICATION

This application claims priority of Korean Patent Application number 2001-26760, filed May 16, 2001.

BACKGROUND OF THE INVENTION

1. Field of the Invention

This invention relates to a door unlocking system for vehicle, and more particularly, to the door unlocking system in which a switch for simultaneously unlocking the front and rear doors is installed regardless of a door chassis and a key rotor.

2. Description of the Prior Art

Generally, the driver's door includes a switch for transmitting a signal to a central processing unit, wherein the driver inserts the key into the key box and turns the key to one direction to simultaneously unlock the front door and rear door while the driver turns the key inserted in the key box to the other direction to simultaneously lock the front door and rear door.

The prior art (FIG. 1) shows installation of a switch 10 rearward of the key box 20, which is disadvantageous in that the narrow space between a door chassis and a key rotor does not allow the switch 10 to be installed rearward the key box 20.

SUMMARY OF THE INVENTION

Accordingly, it is an object of the present invention to provide a door unlocking system for unlocking the front and rear doors by outputting to the central processing unit from the switch in the directions from the neutral position of the key inserted into the key box, in which the switch is installed at the door latch for unlocking the driver s door, and the switch transmits the signal to the central processing unit according to the signal input in the key rod clip to unlock the other doors. The key rod clip and the switch are connected by a key rod link, link and a switch link. The key rod link is connected to the key rod clip at one end, the link is connected to the key rod link at the other end, and switch link is connected to the link 34 and the switch, respectively.

BRIEF DESCRIPTION OF THE DRAWINGS

The present invention will become more fully understood from the detailed description given hereinbelow and the accompanying drawings, which are given by way of illustration only, and thus, are not limitative of the present invention, and wherein.

DESCRIPTION OF THE PREFERRED EMBODIMENTS

Figure 1:
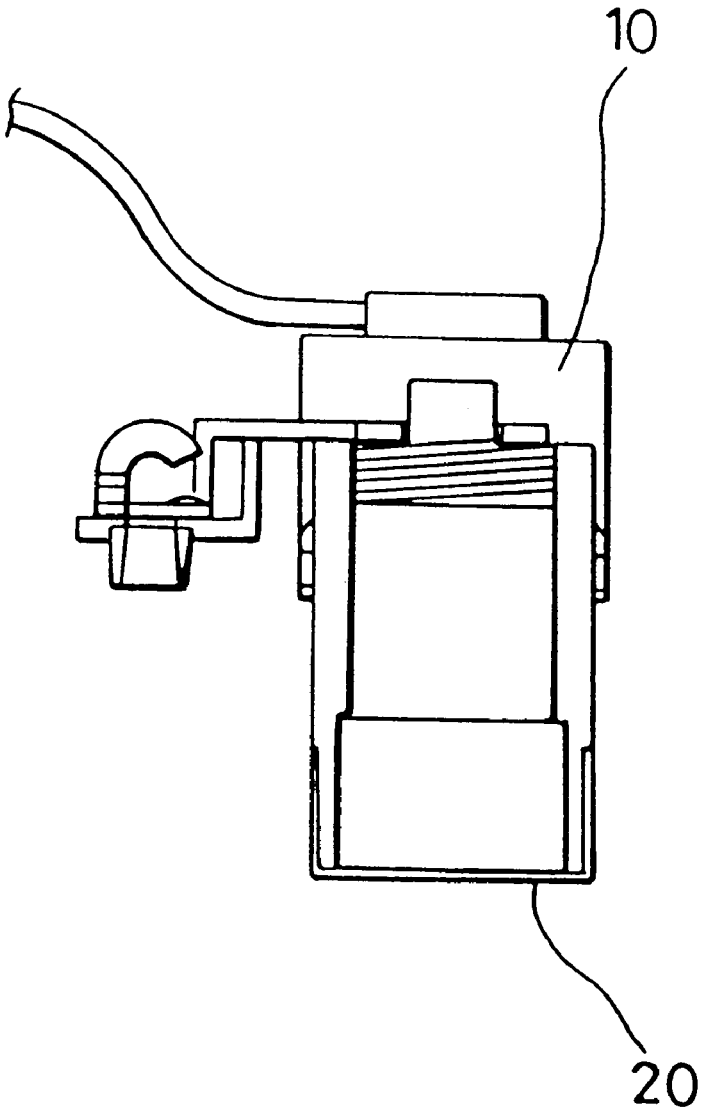
FIG. 1 PRIOR ART
FIG. 1 is a sectional view showing the installation of the conventional switch.
Figure 2:
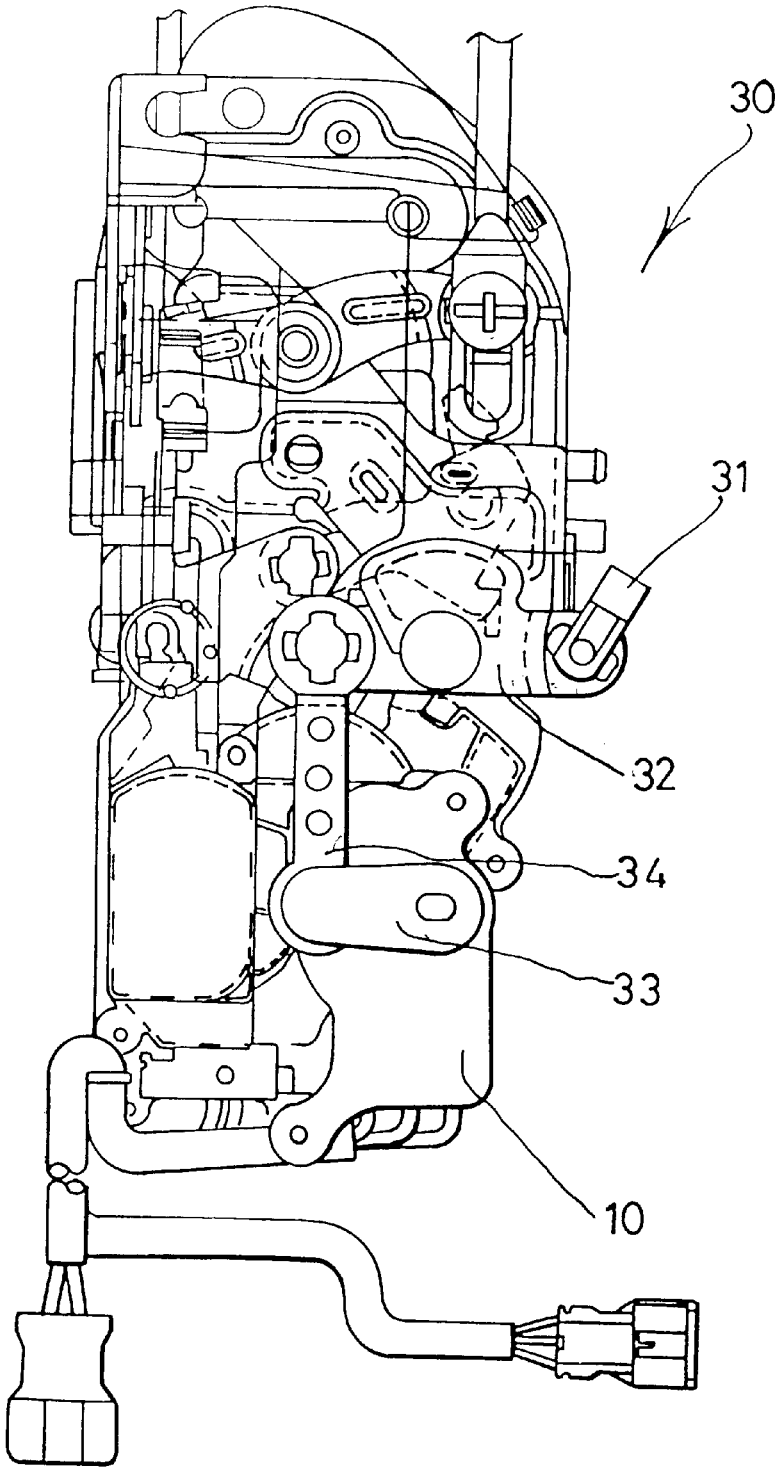
FIG. 2 is a sectional view showing the installation according to the present invention.

As shown in FIG. 2, the door unlocking system of the present invention adopts the conventional switch 10 transmitting the signal to the central processing unit, dependent on the activating direction of the ignition key inserted in the key box, to unlock the front and rear doors.

In the present invention, however, the switch 10 is installed at the door latch 30 for unlocking the driver's seat door and transmits the signal to the central processing unit according to the signal input in the key rod clip 31, to unlock the other doors.

The key rod clip 31 and the switch 10 are connected by a key rod link 32, link 34 and a switch link 33. The key rod link 32 is connected to the key rod clip 31 at one end, the link 34 is connected to the key rod link 32 at the other end, and switch link 33 is connected to the link 34 and the switch 10, respectively.

According to the present invention, when the driver in a car inserts the key into the key box and turns the key in one direction, the rotation force of the key is transmitted as a rectilinear movement to the key rod clip 31. The rotation force of the key transmitted to the key rod clip 31 causes the key rod link 32 to rotate and thus cause rectilinear movement of link 34. The actuating force of the key rod link is transmitted as a rotating force to the switch link 33 via the link 34.

After the switch link 33 receives the rotation force from the key, the switch 10 transmits the signal to the central processing unit to unlock the front door and the rear door as well as the driver's door. Switch link 33 is made to turn the contact of the switch ON/OFF, and as a result, movement, in different degrees of the switch link to the switch. This, in turn, causes the switch, depending on the degrees of the rotation of the key to provide different signals to the processing unit, which in turn either opens the driver's door alone or all doors of the vehicle. Thus first degrees of rotation cause a first signal to the processing unit which sends a first signal to open only the driver's door and second degrees of rotation cause a second signal to the processing unit which sends a second signal to open all doors of the vehicle.

Accordingly, the switch 10 is fixed at the door latch 30 and connected to the key rod link 32, link 34 and switch link 33, so that the switch 10 can be installed separate from the key box.

The present invention is not limited to these embodiments, and it should be clear to those skilled in the art that other embodiments are possible within the spirit and scope of the invention claimed.

What is claimed is:

1. A door unlocking system for a vehicle for unlocking doors of the vehicle responsive to a signal outputted to a central processing unit, said signal indicating a direction of movement of a key in a key box of the vehicle in different degrees of rotation of the key in the key box, the system comprising:

a switch installed in a door latch for unlocking a driver's door of the vehicle; and a key rod clip coupled to the switch for providing to the switch an input movement corresponding to the movement of the key, wherein the switch thereby transmits the signal to such central processing unit according to the input movement provided by the key rod clip to thereby unlock the doors, and wherein the key rod clip and the switch are connected by a key rod link, a link, and a switch link, whereby the key rod link is connected at one end thereof to the rod clip, the link is connected to another end of the key rod link, and the switch link is connected between the link and the switch.

2. The door unlocking system according to claim 1, wherein the switch transmits different signals depending on the different degrees of rotation of the key.

3. The door unlocking system according to claim 2, wherein the switch transmits a first signal to said central processing unit to open only the driver's door of the vehicle in response to a first degree of rotation of the key.

4. The door unlocking system according to claim 3, wherein the switch transmits a second signal to said central processing unit to open all such doors of the vehicle in response to a second degree of rotation of the key.

* * * * *